United States Patent [19]

Ogawa et al.

[11] 4,146,152

[45] Mar. 27, 1979

[54] CONTAINER OPENER USEABLE TO CLOSE THE OPENED HOLE THEREOF

[75] Inventors: Shinichi Ogawa; Youichi Hirono, both of Tokyo, Japan

[73] Assignee: Toagosei Chemical Industry Co. Ltd., Tokyo, Japan

[21] Appl. No.: 828,439

[22] Filed: Aug. 29, 1977

[30] Foreign Application Priority Data

Mar. 2, 1977 [JP] Japan ..... 52-23825[U]
Mar. 2, 1977 [JP] Japan ..... 52-23826[U]

[51] Int. Cl.[2] ..... B67B 7/24
[52] U.S. Cl. ..... 222/81; 222/151; 222/563
[58] Field of Search ..... 222/81, 83, 151, 563

[56] References Cited

U.S. PATENT DOCUMENTS

| | | | |
|---|---|---|---|
| 2,365,524 | 12/1944 | Court | 222/81 |
| 2,509,369 | 5/1950 | Roberson | 222/81 X |
| 3,406,875 | 10/1968 | Park | 222/151 |

FOREIGN PATENT DOCUMENTS

| | | | |
|---|---|---|---|
| 1208966 | 2/1960 | France | 222/151 |
| 511920 | 1/1955 | Italy | 222/81 |

*Primary Examiner*—David A. Scherbel
*Attorney, Agent, or Firm*—Bard & Groves

[57] ABSTRACT

Disclosed herein is an opener for an adhesive container with a nozzle, which comprises a sharp member capable of making a hole in the closed end portion of the nozzle provided on the adhesive container body, the sharp member having a tapered sharp section which is used to make the hole in the closed end portion of the nozzle.

2 Claims, 14 Drawing Figures

CONTAINER OPENER USEABLE TO CLOSE THE OPENED HOLE THEREOF

BACKGROUND OF THE INVENTION

This invention relates to an auxiliary member for opening the closed end portion of the nozzle of a liquid container, the nozzle being used for discharging the liquid out of the container. The auxiliary member herein disclosed is to open the nozzle safely, readily and positively, by preventing the splashing of the liquid which may be caused when it is opened thereby.

Most extensively known as a container for adhesive, especially for α-cyanoacrylate adhesive, is a container inert to adhesive which, as shown in FIG. 1, comprises a liquid containing section 1, a shoulder 2 protruded from the section 1, a nozzle 3 protruded from the shoulder 3, a sealing member 4 screwed into a liquid charging mouth provided at the bottom of the container, and a cap 5 manufactured separately.

In order to use the liquid contained in such a container, a hole is made in the tip end portion of a nozzle provided on the container by the use of a sharp member such as a pin, and the liquid is discharged through the hole thus made. However, in this conventional method in which the hole is made by the use of the pin only, in making the hole in the tip end portion of the nozzle the liquid is jetted out through the hole thereby to make the clothes or articles around it dirty, which may be hazardous to human bodies. Especially, in the case where α-cyanoacrylate adhesive is contained in the container, it may be jetted out of the hole made in the nozzle because of a temperature difference although the container is, in general, stored in a cooling room.

In general, the sharp member such as a pin, as shown in FIG. 2, is made up of a head 8 if necessary, a tapered sharp section 7 at the end portion, and a rod-like section 6 extended from the tapered sharp section 7 and having the same diameter as that of the section 7. In making a hole in the tip end portion of the nozzle with this sharp member, the section 7 is abutted against the tip end portion of the nozzle, and then the sharp member is depressed by holding the head 8 of the rod-like section 6.

In this case, as the section 7 is shorter than the section 6, the hole is made in such a manner that the rod-like section is inserted into the tip end portion of the nozzle because of the inertia of depression.

In the conventional hole making method in which the rod-like section is also used, the liquid is jetted through the hole when the sharp member is pulled out of the nozzle. The reason for this phenomenon is not known. However, it is believed that when the needle is pulled out of the nozzle, the part of the needle inserted into the nozzle is abruptly changed from the rod-like section to the tapered sharp section, as a result of which a change is caused in the opening of the nozzle which leads to the jetting of liquid.

In this connection, α-cyanoacrylate series adhesive known as a low viscosity liquid adhesive is contained in a container with a nozzle made of synthetic resin such as polyethylene or polypropylene which is ordinarily inert to adhesive. In order to make a hole in the nozzle of such a container, it is desirable that after removal of the liquid left in the end portion of the container with the finger tip, the hole is made therein. As it is difficult to completely remove the liquid from the end portion of the container, a small amount of liquid is liable to be left there, even if tried to do so. If a hole is made in the nozzle of this container having the small amount of liquid as it is according to the conventional method in which the needle is inserted into the nozzle up to the rod-like section 6, the above-described jetting of liquid due to the small amount of liquid left in the end portion of the container is caused when the needle is pulled out. Thus, opening the container containing α-cyanoacrylate series adhesive must be done with special care.

SUMMARY OF THE INVENTION

Accordingly, an object of this invention is to provide a container opener with which the above-described difficulties accompanying a conventional container opener can be eliminated, and the nozzle of a container containing adhesive can be safely and readily opened.

More specifically, an object of the invention is to provide an opener for an adhesive container with a nozzle, which comprises a sharp member capable of making a hole in the closed end portion of the nozzle provided on the adhesive container body, the sharp member having a tapered sharp section which is used to make the hole in the closed end portion of the nozzle.

DETAILED DESCRIPTION OF THE INVENTION

In the case of a basic container opener according to this invention, comprises a sharp member like pin or needle having one end formed with a head portion and the other end being a point. The needle includes a tapered portion adjacent the point thereof and a member for permitting only the tapered portion to be inserted into a top of the nozzle of the container.

Figure 3:
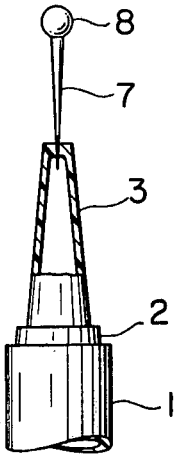
FIG. 3 is a side view, with parts cut away, showing an embodiment of a container opener according to the invention.

FIG. 3 shows one embodiment of the present invention in which the tapered portion 7 constitutes a substantial portion of the needle and the head portion 8 may function as the member for permitting the selective insertion of the needle or sharp member.

Figure 4A:
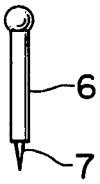
FIG. 4 is side views illustrating various embodiments of the container opener according to the invention. In (a) of FIG. 4, a container opener has a shoulder. In (b) of FIG. 4, a container opener has a sheath. In (c) of FIG. 4, a container opener has a stopper like a flange.
Figure 4B:
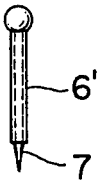
Figure 4C:
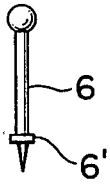

There are a variety of such sharp members as shown in (a) through (c) of FIG. 4.

More specifically, in (a) of FIG. 4, the rod-like section 6 is made heavier so as to provide a shoulder between the rod-like section 6 and the tapered sharp section 7 whereby the insertion of the container opener is stopped at the shoulder. In (b) of FIG. 4, a sheath 6' is put on the conventional rod-like section so as to expose the tapered sharp section 7. In (c) of FIG. 4, a stopper 6' like a flange is provided at the end of the rod-like section. The container opener may be anything if it can achieve the above-described object.

Figure 1:
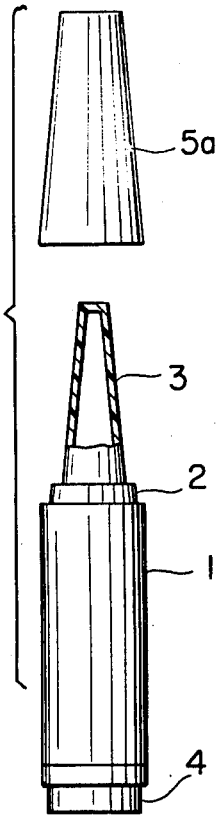
FIG. 1 is a side view, with parts cut away, showing an example of the body of an adhesive container with a nozzle and of its cap to which a container opener according to this invention can be applied, and referred to already.
Figure 2:
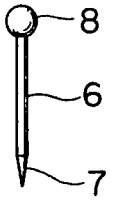
FIG. 2 is a side view showing a needle for opening the nozzle of an adhesive container and referred to already.
Figure 5:
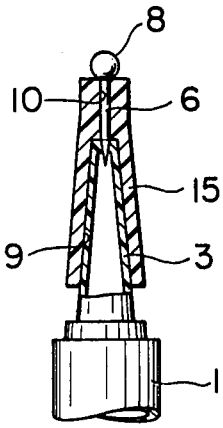
FIG. 5 is a sectional view showing another embodiment of the container opener according to the invention.

In the above-described examples, means for allowing only the tapered sharp section 7 to be inserted into the container is provided by the needle. However, such means may be provided by a cap 5 and a needle having a tapered section, or the combination of these element and a suitable auxiliary member. One example of the combination of an auxiliary member 15 and the needle shown in FIG. 2 is illustrated in FIG. 5. More specifically, the auxiliary member, as shown in FIG. 5, comprises a cap-shaped body 15 having a recessed portion 9 capable of covering a nozzle end portion like the nozzle 3 shown in FIG. 1, and a guide hole 10 penetrating from the top of the cap-like body to the bottom of the recessed portion 9.

The above-described auxiliary member is used in such a manner that the nozzle 3 of the container 1 is inserted so as to cover the recessed portion 9, and a hole making needle 6 is inserted into a guide hole 10 as shown in FIG. 2 to the closed end of the nozzle 3.

After making the hole, the auxiliary member is pulled upward so as to remove the needle simultaneously, as a result of which pouring the liquid contained in the container can be effected.

By the use of such an auxiliary member, the needle is precisely abutted against the closed end portion of the nozzle, and a hole is made in the nozzle 3 with the tapered portion 7 only. Accordingly, making the hole is always achieved successfully. In addition, as the periphery of the hole is surrounded by the auxiliary member during the hole making operation, and the needle is pulled out together with the auxiliary member, the liquid in the container will never be scattered or splashed. That is, the hole can be made safely and readily, which leads to a suitable handling of the liquid.

In this connection, it is desirable that the auxiliary member is so formed that the recessed portion 9 is in close contact with the nozzle 3, and it is also desirable that the length of the nozzle and the configuration of the recessed portion are defined so that the tip end portion of the nozzle is in contact with the bottom of the recessed portion 9. If there is a gap between the tip end of the nozzle and the bottom of the recessed portion 9, sometimes it is difficult to make a hole in the nozzle.

The length of the guide hole 10 in the auxiliary member according to this invention depends on the length of a needle used. However, it is ideal that the length of the guide hole 10 is such that the head 8 of the needle is retained by the auxiliary member so that only the end portion, or the tapered sharp section 7, of the needle appears in the recessed portion 9 and the closed end portion of the nozzle is penetrated by the tapered sharp section 7.

It is desirable that the needle used with the auxiliary member according to the invention has a spherical head; however, the head may be flat or angular one, or it may be obtained by bending the needle body.

In this case, it is preferable that the configuration of the auxiliary member is designed in accordance with the configuration of the needle head.

Figure 6:
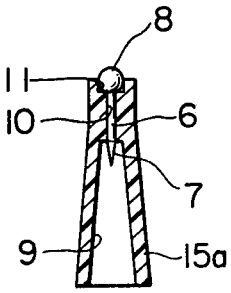
FIG. 6 is a sectional view showing a further embodiment of the present invention.

In the case when, for instance, a needle having a head as shown in FIG. 2 is used, a recessed portion 11 is formed in the top portion of the auxiliary member as shown in FIG. 6 so that at least one half of the needle head is lost in the recessed portion 11 so as to prevent the removal of the needle only.

If the auxiliary member is so designed that only the needle can be pulled out after a hole has been made in the nozzle by the needle, only the needle may be pulled out by mistake. If the needle only is removed from the auxiliary member this way, the liquid in the container will be jetted out or leaked out through the insertion hole 10 of the auxiliary member, as a result of which the trouble that the liquid is solidified in the insertion hole 10 is liable to be caused. However, if the auxiliary member is designed as described above, the trouble can be positively prevented. In addition, in making a hole in the top portion of the nozzle 3, the auxiliary member is placed over the nozzle with the needle head 8 inserted in the recessed portion 11, and when the tip end of the nozzle 3 reaches the bottom of the recessed portion 9, the needle is pushed upward as much as its length protruded in the recessed portion 9 by the tip end of the nozzle because the needle is not fixedly or strongly secured to the auxiliary member. Then, the aimed hole can be made accurately and safely by depressing the needle head 8.

Thus, the removal of the needle after making the hole in the nozzle cannot be done without the use of the auxiliary member; that is, it is absolutely impossible to pull out the needle only. Accordingly, the troubles that the liquid is jetted out or leaked out and solidified in the guide hole can be positively prevented.

The auxiliary member according to the invention can be combined with a cap 15 or employed as a part of the cap. Alternatively, the auxiliary member, the cap, and the needle may be combined into one unit so as to be convenient in carrying and handling.

Figure 7:
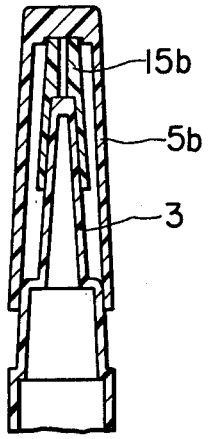
FIG. 7 is a sectional view showing a first example of an auxiliary member according to the invention, which is incorporated in the cap of a adhesive container.
Figure 8:
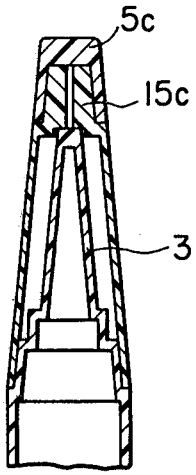
FIG. 8 is also a sectional view showing a second example of the auxiliary member which is placed over the top end portion of the cap.
Figure 9:
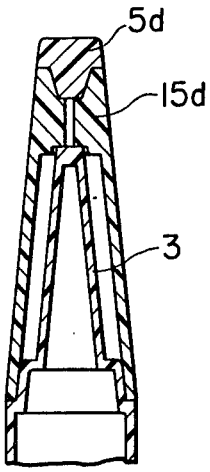
FIG. 9 is also a sectional view showing a third example of the auxiliary member which is obtained by modifying the auxiliary member and the cap shown in FIG. 7.

For this purpose, considered are a structure in which, as is shown in FIG. 7, an auxiliary member 15*b* is placed over the nozzle 3, and the nozzle 3 and the auxiliary member 15*b* are covered with a cap so as to seal the container; a structure in which as is shown in FIG. 8, the nozzle 3 is covered with an auxiliary member 15*c*, and the top end portion of the auxiliary member 15*c* is covered with a cap 5*c*; and a structure in which as is shown in FIG. 9, a state of placing a cap 5*d* on the top end portion of the auxiliary member 15*d* covering the nozzle 3 is different from that in FIG. 8. Furthermore, it is possible that as shown in FIG. 9, a cap 5*e* is placed over the nozzle 3, and then an auxiliary member 15*e* is fitted to the top end portion of the cap 5*e*.

Figure 10:
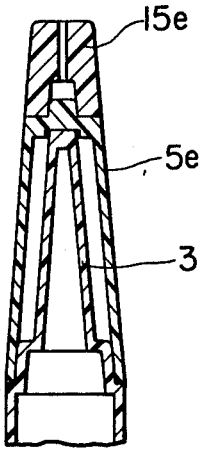
FIG. 10 is a sectional view illustrating a case where an auxiliary member is fitted onto the cap of an adhesive container.
Figure 11:
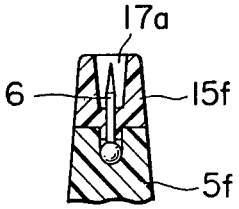
FIG. 11 is a partial sectional view illustrating a combination of the cap, the auxiliary member, and the needle.
Figure 12:
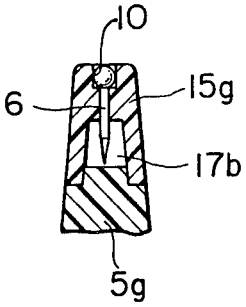
FIG. 12 is also a partial sectional view illustrating another combination of the cap, the auxiliary member, and the needle.

If a needle is incorporated in the structure shown in FIG. 10, the following various structures employing the auxiliary members according to this invention can be considered: For instance, as is shown in FIG. 11, a needle 6 is penetrated through an auxiliary member 15*f*, and the auxiliary member with its recessed portion held upward is placed on the top end portion of a cap 5*f*. In a structure shown in FIG. 12, a needle 6 is penetrated through an auxiliary member 15*g*, and the auxiliary member with its recessed portion held downward is placed on the top end portion of a cap 5*g*.

Known in the art is a structure in which a hole making needle is integral with a cap and protruded from the bottom of the cap in order to make a hole in a container with a nozzle. However, such a cap with a needle suffers from various disadvantages that its manufacture is rather difficult in molding and accordingly high in cost, and that as the needle penetrates the nozzle before the tip end portion of the nozzle reaches the bottom of the cap, it is difficult for the needle to take the accurate hole making position, which leads to a failure in making a hole in the nozzle.

According to this invention, these difficulties can be positively eliminated. More specifically, according to the invention, the cap, the hole making auxiliary member, and the needle are individually manufactured, and accordingly the manufacturing cost can be decreased. In addition, making a hole in the nozzle can be accurately and safely carried out by utilizing the guide hole provided in the auxiliary member. In these points the present invention, unlike the conventional method, is excellent in practical use.

As is apparent from the above description, according to this invention, making a hole in the nozzle of the container with the container opener is carried out by only the tapered sharp section 7 of the needle 6, and the hole thus made is sealed with the tapered sharp section 7 only, and therefore the liquid will never be leaked out after the hole is made in the nozzle of the container.

What is claimed is:

1. An opener for an adhesive container with a nozzle, which is associated with a cover member, comprising a needle having one end formed with a head portion and the other end being a point adapted to be inserted into a top of said nozzle, said needle including a tapered portion adjacent said point thereof and a non-tapered portion between said head and said tapered portion, and a member for permitting only said tapered portion to be inserted into a top of said nozzle, said member being an auxiliary member having a first recess fittable on said nozzle of said container and a through guidehole extending between a top surface of said auxiliary member and said first recess, the axial length of said through guidehole being equal to the length of said non-tapered portion of said needle.

2. An opener as claimed in claim 1, wherein a second recess portion for receiving said head portion of said needle is formed in said top surface of said auxiliary member.

* * * * *